US006186620B1

(12) United States Patent
Hsieh et al.

(10) Patent No.: US 6,186,620 B1
(45) Date of Patent: Feb. 13, 2001

(54) INK PRESSURE CONTROL APPARATUS FOR INK-JET PENS

(75) Inventors: Shu-Cheng Hsieh, Hsinchu Hsien; I-Chung Hou, Hsinchu; Cheng-Wei Hsu, Yungkang; Chi-Chien Lin, Hsinchu Hsien, all of (TW)

(73) Assignee: Industrial Technology Research Institute, Hsinchu (TW)

( * ) Notice: Under 35 U.S.C. 154(b), the term of this patent shall be extended for 0 days.

(21) Appl. No.: 09/287,965

(22) Filed: Apr. 7, 1999

(30) Foreign Application Priority Data

Feb. 12, 1999 (TW) ..... 88102229

(51) Int. Cl.[7] ..... B41J 2/17
(52) U.S. Cl. ..... 347/84
(58) Field of Search ..... 347/84, 85, 86, 347/87, 92; 222/1, 206, 212

(56) References Cited

U.S. PATENT DOCUMENTS 5,608,437 * 3/1997 Iwata et al. ..... 347/86
5,917,523 * 6/1999 Baldwin et al. ..... 347/85
5,988,803 * 11/1999 Komplin et al. ..... 347/86

* cited by examiner

*Primary Examiner*—N. Le
*Assistant Examiner*—Michael Nghiem
(74) *Attorney, Agent, or Firm*—W. Wayne Liauh

(57) ABSTRACT

The present invention provides a pressure control apparatus for an ink-jet pen. The apparatus will adjust the back pressure of ink in the reservoir of the ink-jet pen in a suitable range when the ink is used gradually. The apparatus includes a pressure adjusting element and a hole furnished on the bottom wall of a reservoir. Under normal condition, the pressure adjusting element contacts tightly to the hole and prevents air from ingression. When the back pressure increases gradually to an extent, the ambient air will overcome the pressure of a spring which provides force to the pressure adjusting element, thus move the pressure adjusting element to leave a clearance to the hole and let some air bubbles ingressing into the reservoir till the back pressure decreases to a certain value. After the back pressure returns to the certain value, the pressure adjusting element further contacts the hole and prevents air from ingression, thus maintains a suitable back pressure of the ink in the reservoir.

9 Claims, 9 Drawing Sheets

INK PRESSURE CONTROL APPARATUS FOR INK-JET PENS

BACKGROUND OF THE INVENTION

The present invention relates to a pressure control apparatus for an ink-jet pen. The apparatus will adjust the back pressure of ink in the reservoir of the inkjet pen within a suitable range when the ink is used gradually.

Drop-on-demand printing is a general method for controlling ink drops from an inkjet pen reservoir to a printing surface. The print heads typically use thermal bubble or piezoelectric pressure wave mechanisms for ejecting drops. A thermal bubble type print head includes a thin-film resistor that is heated to cause sudden vaporization of a small portion of the ink. The rapid expansion of the ink vapor forces a small amount of ink through a print head orifice. Though a drop-on-demand print head is effective for ejecting ink drops from a pen reservoir, it needs another control mechanism for preventing ink from permeating through the print head when the print head is inactive. Generally the control mechanism is to provide a slight back pressure at the print head to prevent ink leakage from the pen whenever the print head is inactive. The term "back pressure" means the partial vacuum within the pen reservoir that resists the flow of ink through the print head. Back pressure is considered in the positive sense so that an increase in back pressure represents an increase in the partial vacuum.

The back pressure at the print head must be strong enough for preventing ink leakage. However, it must not be so strong that the print head is unable to overcome the back pressure to eject ink drops. Moreover, the back pressure must be adjusted itself according to the variance of environmental air pressure. For example, during air transport of an inkjet pen, the ambient air pressure decreases as the aircraft gains altitude, a correspondingly greater amount of back pressure is needed to keep ink from leaking through the print head. On the other hand, the back pressure within an ink-jet pen reservoir is also affected by "operational effects". As the print head is activated to eject ink drops, the consequent depletion of ink from the reservoir increases the reservoir back pressure. If the back pressure increase is not well regulated, the ink drops will reduce their size, lose printing quality or even fail to be ejected because the print head is unable to overcome the increased back pressure.

In the prior arts, a back pressure control mechanism is an accumulator mounted inside the ink-jet pen reservoir. The accumulator is usually an expandable bag capable of changing its volume between a minimum volume and a maximum volume, therefore to adjust the reservoir volume for storage of ink, and to regulate the back pressure of the reservoir. For example, when the ambient air pressure decreases, the expandable bag will then be contracted to reduce its volume and relatively to increase the reservoir volume for storage of ink, and therefore to increase the back pressure of reservoir for preventing ink from leakage.

A prior art is disclosed in U.S. Pat. No. 5,409,134. As shown in FIG. 1 and FIG. 2, an accumulator 14 is configured to fit into an ink-jet pen 10 that includes a cap 12, a reservoir 11 having rigid side walls 111 and a bottom wall 112 that are configured to hold a quantity of ink. A thermal-bubble type print head 13 is fit into the bottom wall 112 of the reservoir 11 for ejecting ink drops from the reservoir 11 to an unshown print paper. The accumulator 14 includes an expandable bag 142*a*, 142*b* that is mounted to a spring 141*a*, 141*b*. The bag 142*a*, 142*b* and spring 141*a*, 141*b* are aligned with pins 147 and fastened via a base 145 to the cap 12 in a manner that the interior of the bag 142*a*, 142*b* is in fluid communication with ambient air through a breather strip 148 and an air duct 149. With the accumulator 14 in place, the reservoir 11 is filled with ink 50 with a slight (minimum) back pressure established within the pen reservoir 11. The minimum back pressure is the back pressure necessary to keep ink 50 from leaking through the print head 13 when the print head is inactive.

As the pen 10 is used for printing, the air pressure within the reservoir 11 decreases (hence, the back pressure increases) as ink is depleted. As shown in FIG. 1, during printing, the bag 142*a*, 142*b* expands as a result of the back pressure increase. The bag expansion decreases the volume of the reservoir 11 to maintain the reservoir back pressure within a range such that the print head 13 is able to continue ejecting ink from the reservoir 11. As shown in FIG. 2, if the ambient pressure should thereafter decrease (for example, during air transport of the pen), the bag 142*a*, 142*b* will contract to increase the reservoir volume so that the back pressure within the reservoir 11, relative to ambient, does not drop to a level that permits ink 50 to leak from the print head 13.

From the aforesaid function of the accumulator 14, we may find that the maximum volume of the bag 142*a*, 142*b* is limited. That is, when the bag 142*a*, 142*b* has expanded to its maximum volume, the further depletion of the ink 50 will increase the back pressure of the reservoir 11 to an extent that the print head 13 cannot overcome the pressure to inject ink drops and the ink 50 cannot be fully depleted.

To solve the aforesaid problem, U.S. Pat. No. 5,526,030 discloses a bubble generator as a back pressure control mechanism. As shown in FIG. 3 and FIG. 4, a bubble generator 20 is installed in the bottom 112*a* of a reservoir 11*a* of an ink-jet pen 10. The bubble generator 20 consists of a tubular boss 21 and a sphere 22 mounted concentrically within the boss. The outside diameter of the sphere 22 is smaller than the inside diameter of the boss 21 to define an annular orifice 212. The sphere 22 is maintained within the boss 21 by a number of raised ribs 211 formed around the interior of the boss 21. In this manner the sphere 2 can be easily press fit into the boss 21 and firmly maintained in position by the ribs 211. Additional unshown raised ribs are also provided to help maintaining the sphere 22 in position away from the inside wall of the boss 21. The sphere 22 serves as a capillary member to maintain a quantity of ink within the boss 21. As a result, even when the pen is oriented such that the boss is not submerged in the reservoir ink, a quantity of ink is trapped within the boss to provide a liquid seal. When the back pressure is within the desired range, the bubble generator 21 is sealed with a quantity of ink. However, when the back pressure exceeds the desired range, the back pressure overcomes the capillary forces of the liquid seal and allows the ambient air to bubble into the reservoir 11*a* to reduce the back pressure. When the back pressure returns to the appropriate level, the liquid seal reforms to prevent further ingression of the ambient air.

Therefore, the bubble generator 20 applied in the ink-jet pen 10 must have the capabilities of:

a) A suitable control of bubble ingression for maintaining a suitable back pressure of the reservoir. That is, after bubbles ingressing into the reservoir 11*a* and decreasing the back pressure, the bubble generator 20 has to stop the ingression at a right time in order to maintain a suitable back pressure of the reservoir 11*a*; and b) A self-wetting function for the mechanism that when the ink 50 in the reservoir 11*a* has been depleted to an extent or the bubble generator 20 is not submerged in the reservoir ink due to any angular placement of the ink-jet pen 10, the liquid seal should always functions to prevent bubble ingression and maintain a suitable back pressure of the reservoir 11*a*.

As described above, since the volume of an expendable bag is limited. When the bag has expanded to its maximum volume, the further depletion of the ink will increase the back pressure of the reservoir to an extent that the print head cannot overcome the back pressure to eject ink drops and the ink cannot be fully depleted.

On the other hand, a bubble generator for controlling back pressure of the ink reservoir is based on the capillary forces of the liquid seal, the static pressure of the ink and the configuration of the orifice. A greater capillary force or a smaller orifice clearance requires a higher back pressure for introducing bubble. When the ink is decreased, the static pressure of the ink and the back pressure for introducing bubble are also decreased. Therefore, the demand of maintaining a suitable back pressure of ink reservoir during bubble ingression requires a precise control of the configuration of orifice, i.e. the clearance between the sphere and the boss, which causes difficulties in manufacturing and assembly.

The major objective of the present invention is therefore to provide a back pressure control mechanism for an ink-jet pen, and to solve the aforesaid problems of prior arts. The mechanism will maintain the back pressure in a preset range and prevent it from too high and influencing printing quality of the print head.

A back pressure control mechanism according to the present invention includes a spring element, a pressure adjusting element and a hole furnished on the bottom wall of a reservoir. The pressure adjusting element is installed inside the hole to form a seal for bubble ingression. The spring element connects to the pressure adjusting element for providing contact pressure of the pressure adjusting element to the hole. Under normal condition, the pressure adjusting element contacts tightly to the hole and prevents air from ingression. When the back pressure increases gradually to an extent, the ambient air will overcome the pressure of a spring which provides force to the pressure adjusting element, thus move the pressure adjusting element to leave a clearance to the hole and let some air bubbles ingressing into the reservoir till the back pressure decreases to a certain value. After the back pressure returns to the certain value, the pressure adjusting element further contacts the hole and prevents air from more ingression.

The features and advantages of the present invention will be apparent from the following detailed description, which proceeds with reference to the accompanying drawings.

DETAILED DESCRIPTION OF PREFERRED EMBODIMENTS

First Embodiment

Figure 1:
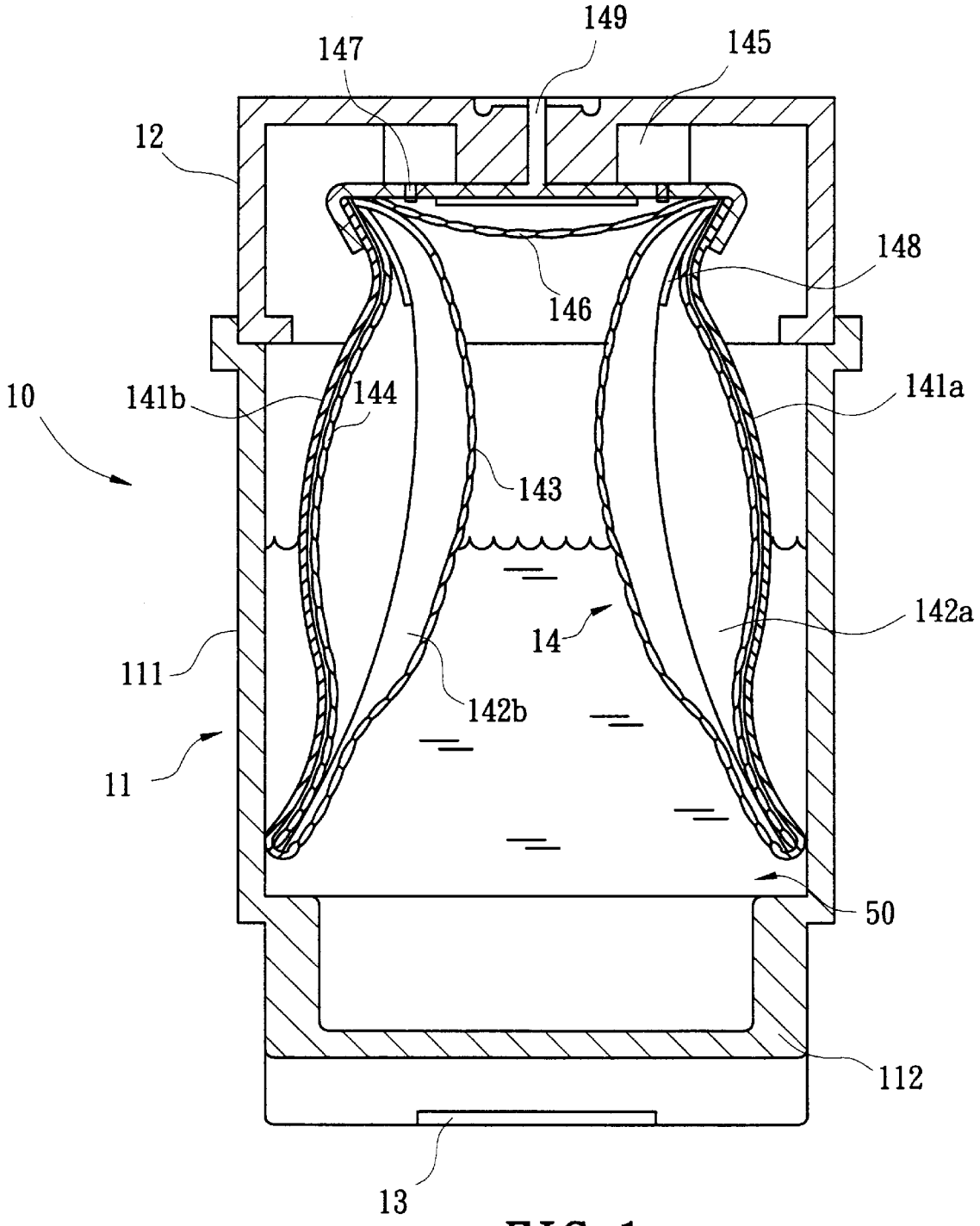
FIG. 1 (Prior Art)
FIG. 1 is a cross section of a prior art ink-jet pen that includes an accumulator shown in an expanded volume position.
Figure 2:
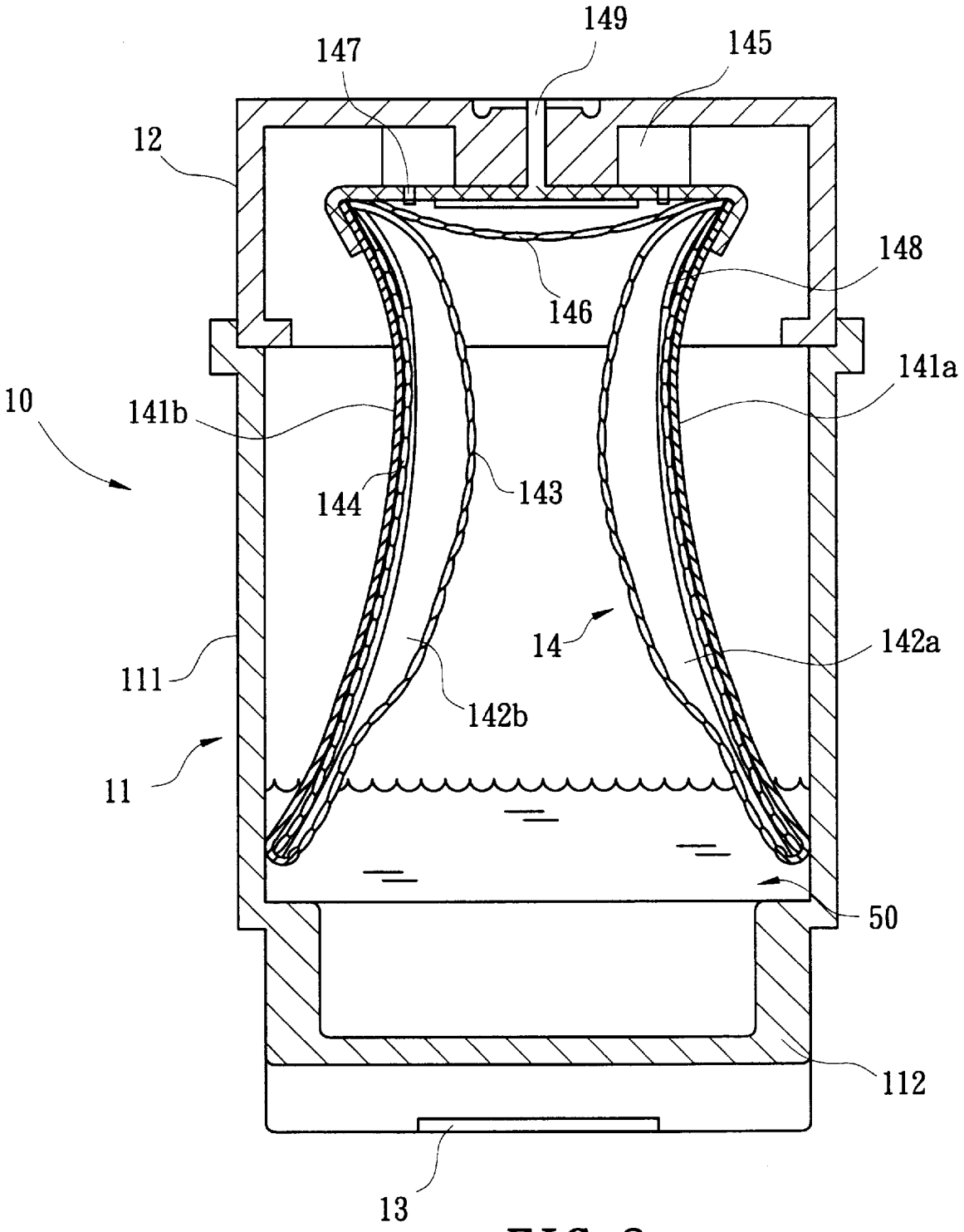
FIG. 2 (Prior Art)
FIG. 2 is a cross section of the accumulator of FIG. 1, showing the accumulator in a contracted volume position.
Figure 3:
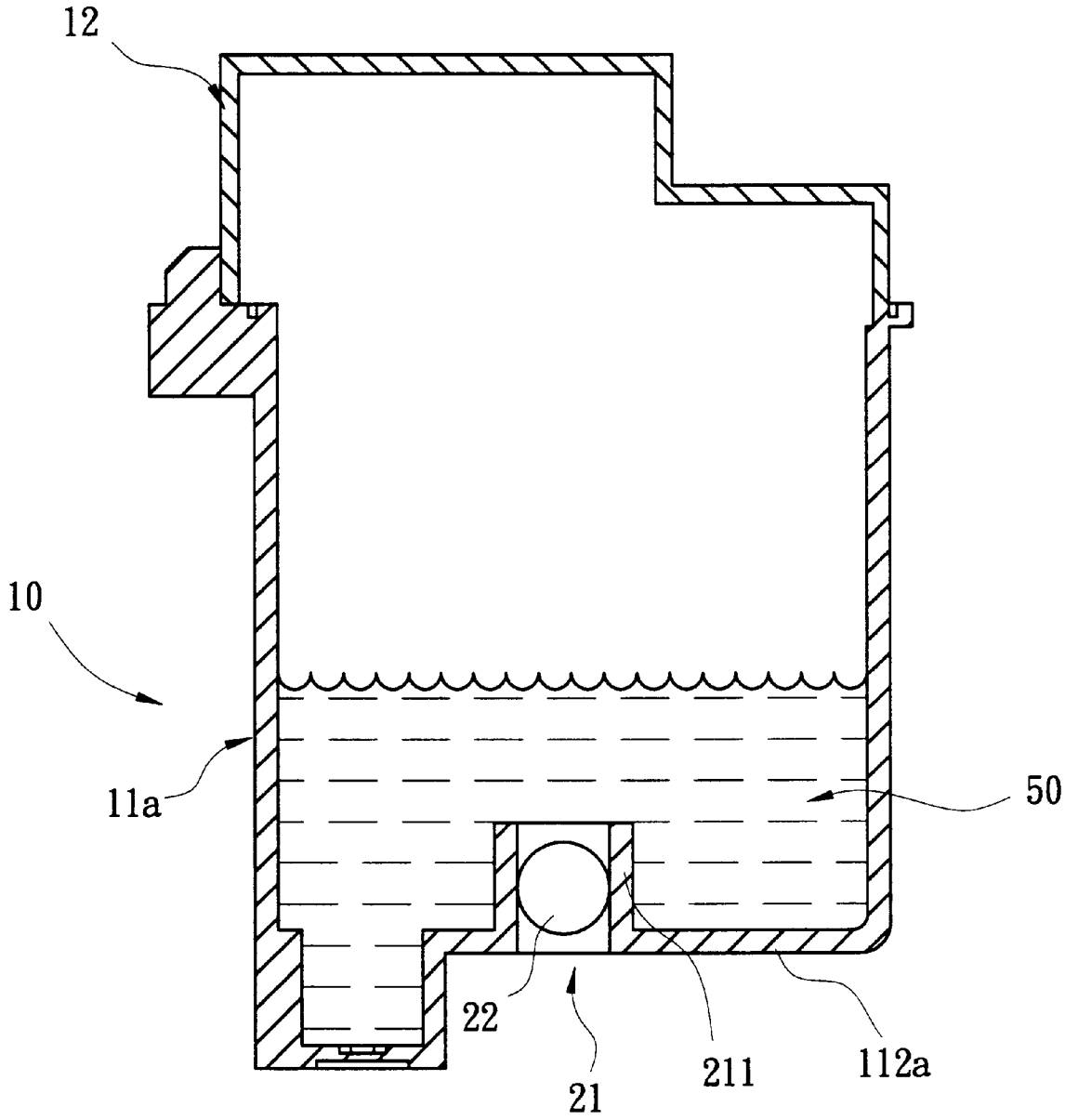
FIG. 3 (Prior Art)
FIG. 3 is a cross section of a prior art ink-jet pen that includes a bubble generator.
Figure 4:
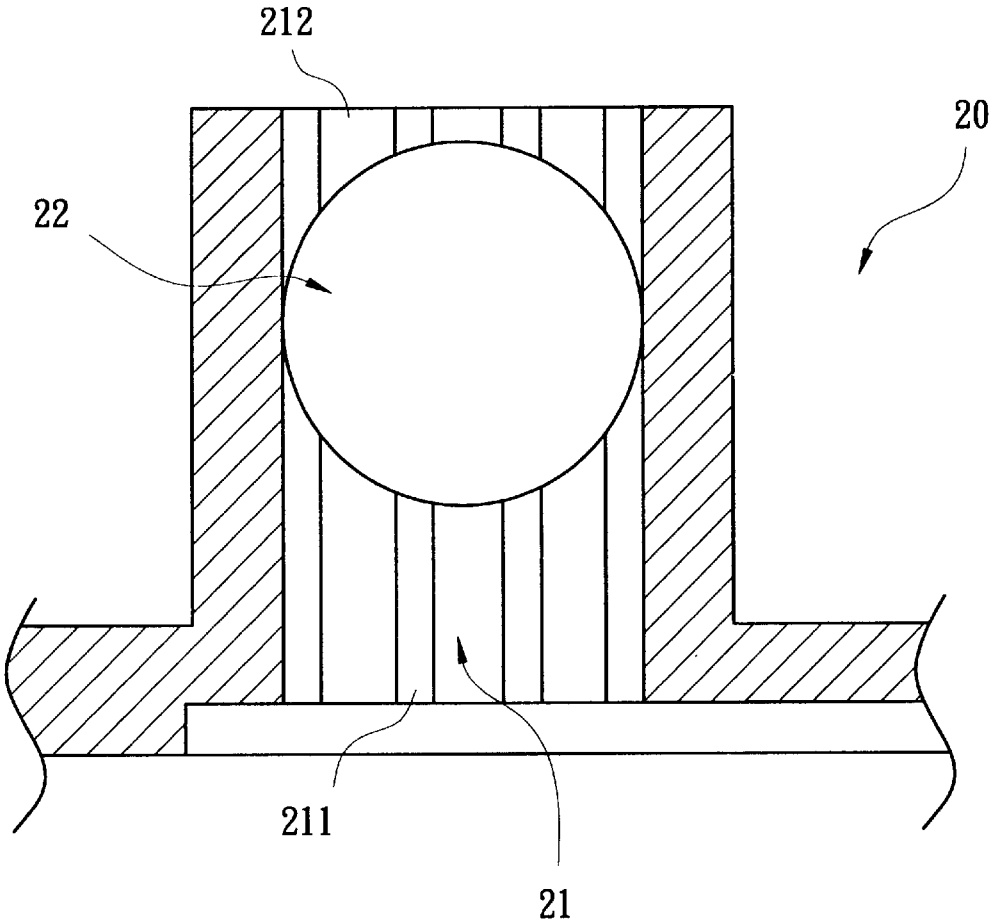
FIG. 4 (Prior Art)
FIG. 4 is an enlarged cross section of the bubble generator of FIG. 3.
Figure 5:
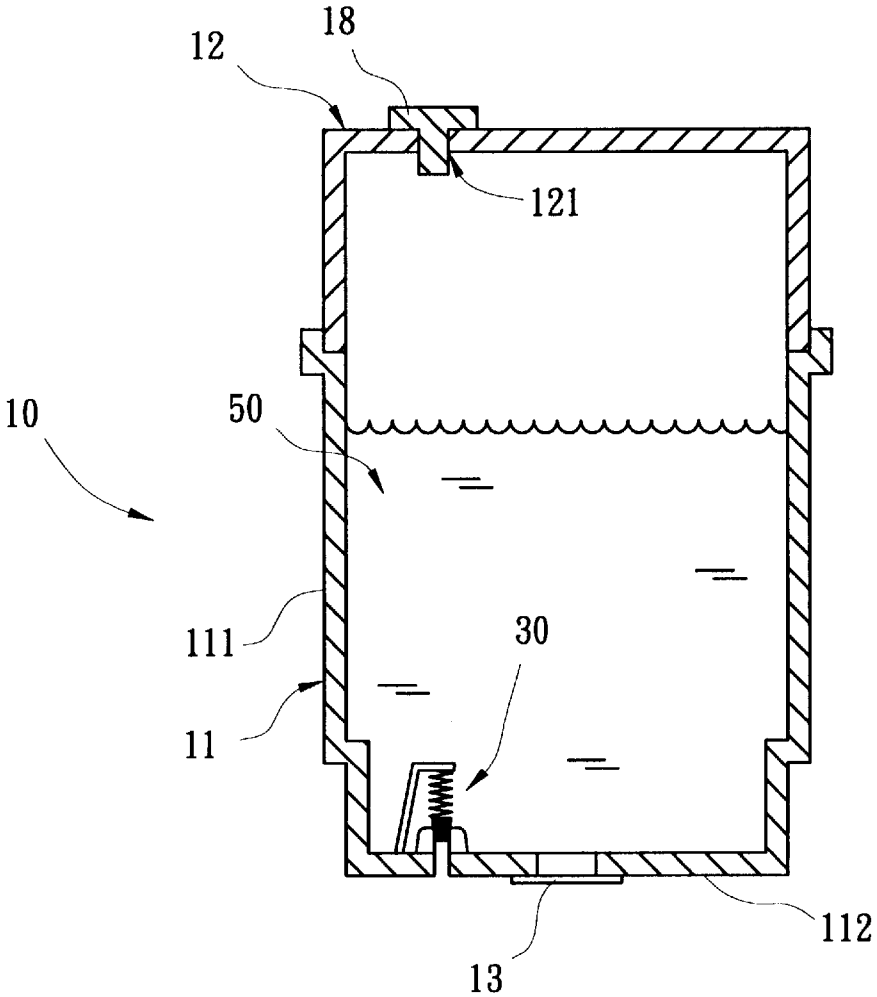
FIG. 5 is a cross section of a first embodiment of pressure adjusting apparatus for an ink-jet pen according to the present invention.
Figure 6:
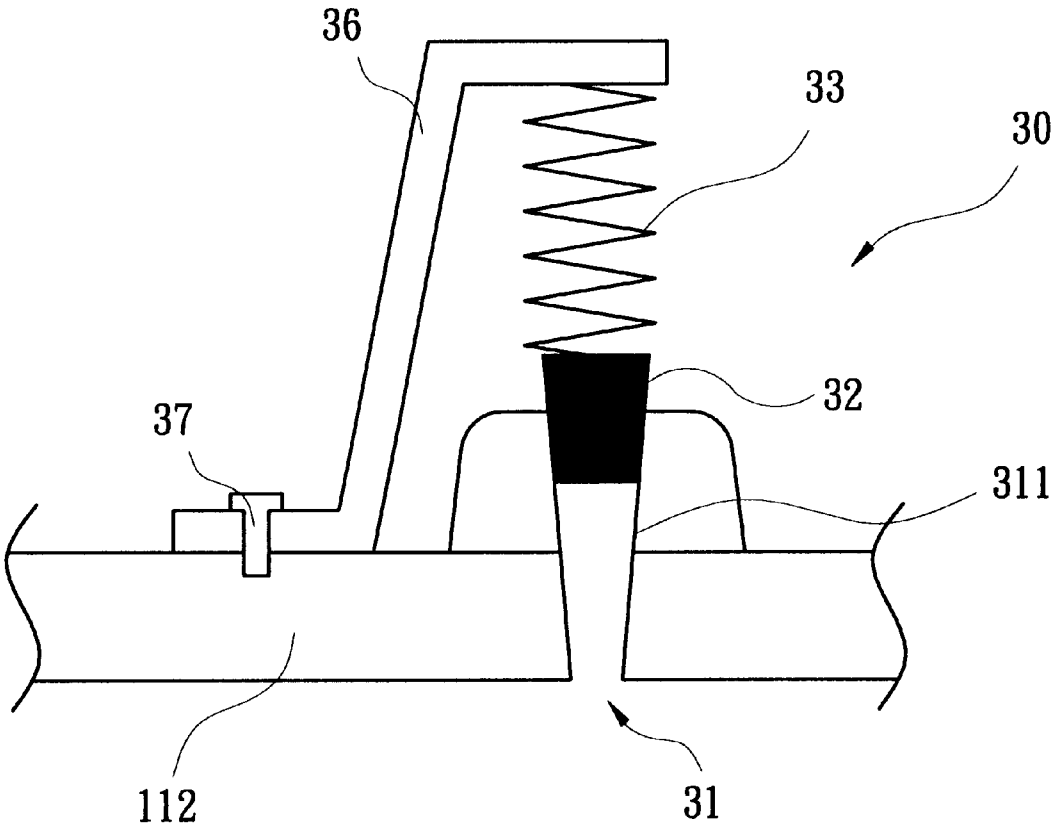
FIG. 6 is an enlarged view of the pressure adjusting apparatus of FIG. 5.

As shown in FIG. 5, a pressure adjusting apparatus as a first embodiment of the present invention is incorporated in an ink-jet pen. The ink-jet pen 10 has side walls 111 and a bottom wall 112 to form an reservoir 11 for ink 50. A pressure adjusting apparatus 30 and a print head 13 is incorporated in the bottom wall 112. As shown further in FIG. 6, the pressure adjusting apparatus 30 includes a hole 31 penetrated through the bottom wall 112 of the reservoir 11; a pressure adjusting element 32, such as a stopper in a shape of cylinder, cone or sphere, contacting with the inner surface 311 of the hole 31; a supporting element 36 having one end fixed on the bottom wall 112 (for example by using a pin 37) and one end suspended from the bottom wall 112 at a position upon the hole; and an elastic element 33, such as a spring, having one end fixed to the supporting element 36 and the other end contracted to the pressure adjusting element 32, for pressing the pressure adjusting element 32 contacting with the hole 31 and controlling the passage formed between the pressure adjusting element 32 and the hole 31 to remain the ink 50 in the reservoir 11 with a suitable back pressure.

Figure 7:
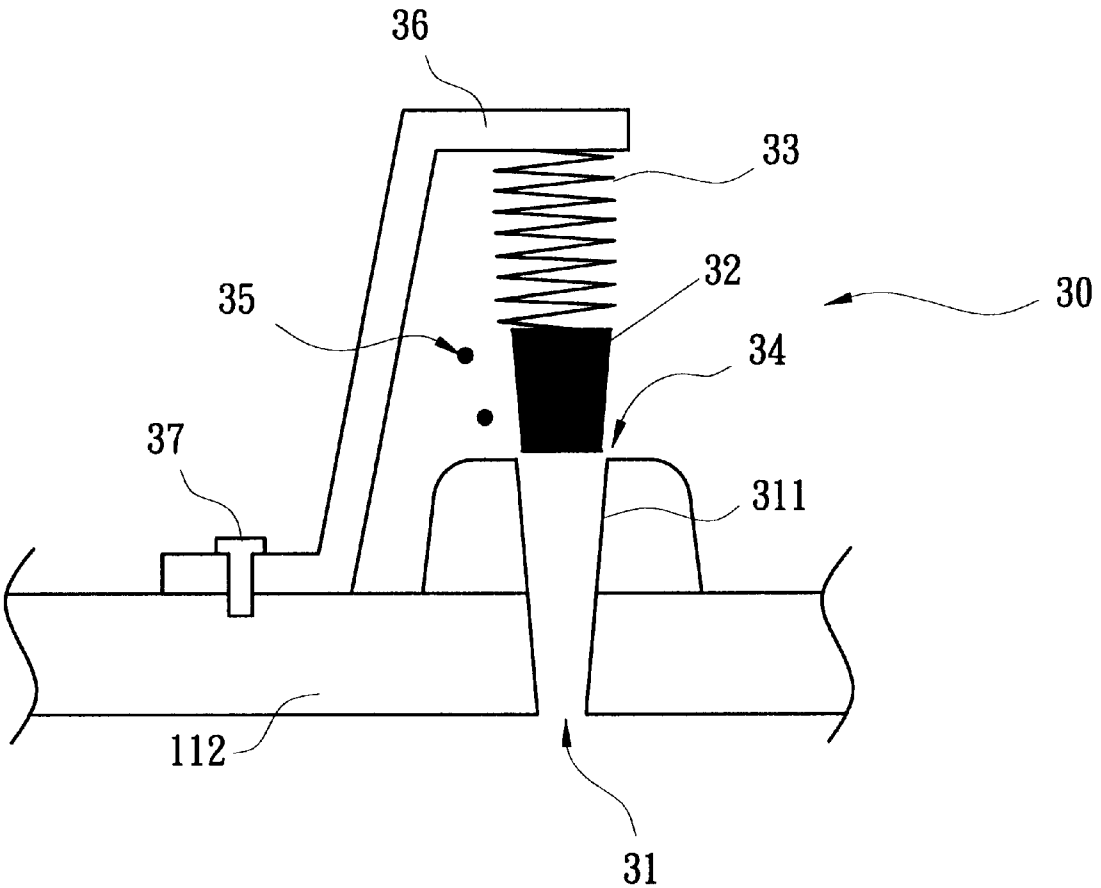
FIG. 7 is a working condition view of the pressure adjusting apparatus when bubbles are generating.

In the aforesaid ink-jet pen 10, the reservoir 11 is sealed by a cover 12. A hole 121 is formed on the cover 12 for filling ink into the reservoir 11, then a cap 18 is used for sealing the hole 121 and maintaining a minimum back pressure in the reservoir 11. When the ink-jet pen 10 is printing, the back pressure (partial vacuum) will be increased responsively to the usage of the ink 50. When the back pressure increases to overcome the strength of the elastic element 33, the pressure adjusting element 32 will then move inwards to leave a clearance 34 (see FIG. 7) between the pressure adjusting element 32 and the hole 31 and allow some ambient air bubbles 35 flowing into the reservoir 1. The air bubbles 35 will decrease the back pressure and will eventually cause the pressure adjusting element 34 to seal the passage to stop bubble ingression to the reservoir 11 by the force of the elastic element 33.

Second Embodiment

Figure 8:
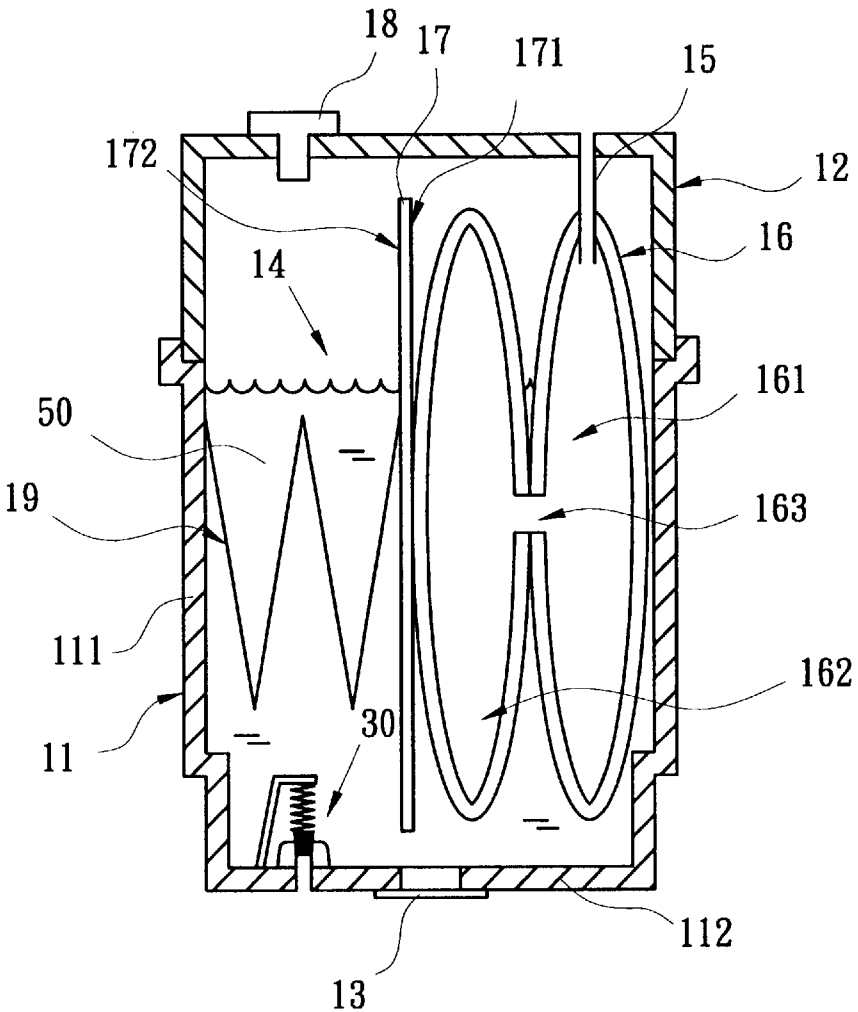
FIG. 8 is a cross section of an ink-jet pen having a pressure adjusting apparatus and an expandable bag.

The ink-jet pen shown in FIG. 8 is based on the embodiment of FIG. 5 and further includes an accumulator 14 installed in the reservoir 11. The accumulator 14 includes an expandable bag 16 connected through a conduit 15 to the cover 12 for conducting air between the bag 16 and the atmosphere. The bag 16 is composed of two cavities 161 and 162 connected through a passage 163. One side of the bag 16 is fixed with a plate 17 at one side 171, and the other side 172 thereof is pressed by a spring 19 which is fixed by one end at the inner side of the reservoir 11.

During printing, the ink 50 in the reservoir 11 is being depleted, and the back pressure is getting higher. The higher back pressure will activate the accumulator 14 that air will be lead through the conduit 15 into the bag 16, expands the bag 16 and presses the plate 17 and the spring 19, therefore decreases the volume of the reservoir 11 for the ink 50 and eventually retains a lower back pressure for the reservoir 11. Upon the ink 50 is used till the bag 16 is expanded fully to its maximum volume, the volume of the reservoir 11 cannot further be reduced, the higher back pressure will then overcome the strength of the elastic element 33, causing the pressure adjusting element 32 to move inward to leave a clearance 34 (see FIG. 7) between the pressure adjusting element 32 and the hole 31 and to allow some ambient air bubbles 35 flowing into the reservoir 11. The air bubbles 35 will decrease the back pressure and further makes the pressure adjusting element 34 sealing the passage to stop bubble ingression to the reservoir 11 by the force of the elastic element 33.

On the other hand, when a lower ambient air pressure happens, the spring 19 will press the plate 17 and the bag 16 to contract the bag 16 (by blowing some air out of the bag 16 via the conduit 15) and to increase the volume of the reservoir 11, therefore maintains a suitable back pressure of the reservoir 11 and prevents ink 50 from leaking through the print head 13.

Figure 9:
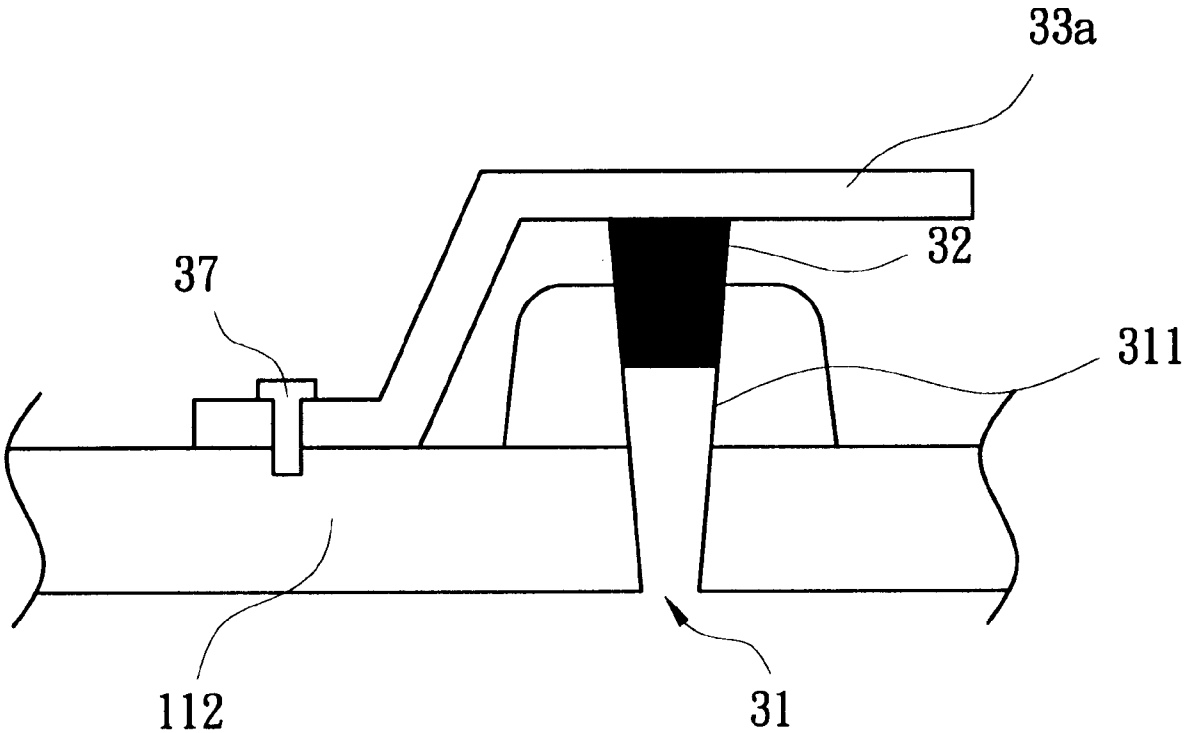
FIG. 9 is a cross section of a second embodiment of pressure adjusting apparatus for an ink-jet pen according to the present invention.

In the above embodiments, the pressure adjusting apparatus 30 can also be composed in a manner as shown in FIG. 9. the pressure adjusting apparatus 30 includes a hole 31 penetrated through the bottom wall 112 of the reservoir 11; a pressure adjusting element 32, such as a stopper in a shape of cylinder, cone or sphere, contacting with the hole 31; and a elastic element 33*a*, such as a spring plate, having one end fixed on the bottom wall 112 (for example by using a pin 37) and one end suspended from the bottom wall 112 at a position upon the hole 31 for fixing the pressure adjusting element 32. The elastic element 33*a* presses the pressure adjusting element 32 to contact with the hole 31 and controls the passage formed between the pressure adjusting element 32 and the hole 31 to remain the ink 50 (as shown in FIG. 5) in the reservoir 11 with a suitable back pressure.

In the same manner, as the back pressure of the reservoir is being increased responsively to the usage of the ink 50, the back pressure will overcome the strength of the elastic element 33*a*, and move the pressure adjusting element 32 inwards to leave a clearance 34 (see FIG. 7) between the pressure adjusting element 32 and the inner surface 311 of the hole 31 and to allow some ambient air bubbles 35 flowing into the reservoir 11. The air bubbles 35 will decrease the back pressure and further makes the pressure adjusting element 34 sealing the passage to stop bubble ingression to the reservoir 11 by the force of the elastic element 33*a*.

The advantages of the invention are:

a) The pressure adjusting apparatus of the present invention doesn't require any precise arrangement of the clearance of a sphere and orifice for controlling the bubble ingression to maintain a suitable back pressure of an ink reservoir;

b) The pressure adjusting apparatus is simple in construction which doesn't occupy the volume of the reservoir;

c) The actuation of the pressure adjusting apparatus is independent to an accumulator in the reservoir. So the back pressure control is not influenced by any other constructional variance; and d) The clearance of the pressure adjusting apparatus to the hole according to the present invention doesn't require a precise arrangement.

Although the invention has been described in connection with preferred embodiments, it will be understood by those skilled in the art that various changes may be made without departing from its scope.

We claim:

1. A pressure adjusting apparatus for controlling back pressure of a reservoir of an ink-jet pen, said apparatus comprising:

a hole penetrated through a bottom wall of said reservoir;

a pressure adjusting element contacting with said hole for normally sealing said hole; and an elastic element for supporting said pressure adjusting element and normally exerting an urging force against said pressure adjusting element;

wherein said pressure adjusting element contains a truncated cone section and said hole contains a matching truncated channel to cooperatively provide a tight sealing during normal operating conditions but allow said channel to be opened therebetween when said back pressure overcomes said urging force exerted by said elastic element.

2. A pressure adjusting apparatus according to claim 1 wherein said pressure adjusting element is a stopper.

3. A pressure adjusting apparatus according to claim 1 wherein said elastic element is a spring plate.

4. A pressure adjusting apparatus according to claim 1 further comprises a supporting element, having one end fixed on said bottom wall and one end suspended from said bottom wall at a position upon said hole, for supporting said pressure adjusting element.

5. A pressure adjusting apparatus according to claim 4 wherein said one end of said supporting element is fixed by a pin on said bottom wall.

6. A pressure adjusting apparatus according to claim 4 wherein said elastic element is mounted between said supporting element and said pressure adjusting element for normally pressing said pressure adjusting element and sealing said hole.

7. A pressure adjusting apparatus according to claim 4 wherein said elastic element is a spring.

8. A pressure adjusting apparatus according to claim 1 which further contains an air accumulator, and said air accumulator comprising:

(a) a second hole formed through a top wall of said reservoir;

(b) a flexible container provided inside said reservoir;

(c) a tube connecting said flexible container with said second hole to allow air to enter and exit said flexible container;

(d) a plate contacting one side of said flexible container; and (e) a spring urging said plate, so as to allow an expansion of said flexible container and provide a buffer for the back pressure in a controlled manner.

9. A pressure adjusting apparatus according to claim 8 wherein said flexible container contains two bags in communication with each other.

* * * * *